United States Patent [19]

Aldrich

[11] Patent Number: 4,972,561

[45] Date of Patent: Nov. 27, 1990

[54] METHOD OF PRODUCING AN ANGLED PIN SEAM IN A PAPERMAKERS FELT

[75] Inventor: W. G. Aldrich, Starkville, Miss.

[73] Assignee: Niagara Lockport Industries Inc., Quincy, Fla.

[21] Appl. No.: 457,090

[22] Filed: Dec. 26, 1989

[51] Int. Cl.[5] ..... D21F 7/10

[52] U.S. Cl. ..... 28/142; 139/383 A; 139/425 A; 162/DIG. 1

[58] Field of Search ..... 28/141, 142; 139/383 A, 139/425 A; 162/DIG. 1

[56] References Cited

U.S. PATENT DOCUMENTS

| | | | |
|---|---|---|---|
| 1,624,049 | 4/1927 | Kurtz-Hahnle . | |
| 2,212,796 | 8/1940 | Schuster | 140/3 |
| 3,478,991 | 11/1969 | Schiel et al. | 245/10 |
| 4,426,795 | 1/1984 | Rudt | 34/116 |

*Primary Examiner*—Werner H. Schroeder
*Assistant Examiner*—Bradley Kurtz DeSandro
*Attorney, Agent, or Firm*—Pettis and McDonald

[57] ABSTRACT

A procedure is described for providing an angled pin seam on a papermakers felt in which a base fabric is woven with a selectively joinable pin seam to form a continuous loop of the base fabric, skewing that base fabric and its seam by displacing one of the lateral edges of the fabric longitudinally of the machine direction relative to the opposed lateral edge while maintaining the machine direction yarns extending substantially in the machine direction, thus skewing the seam relative to the machine direction and to the cross machine direction, and in which batt material is needled into the base fabric while the base fabric is maintained in the skewed condition, whereby the needled batt maintains the fabric in its skewed condition.

6 Claims, 1 Drawing Sheet

METHOD OF PRODUCING AN ANGLED PIN SEAM IN A PAPERMAKERS FELT

BACKGROUND OF THE INVENTION

This invention relates generally to the field of papermakers felts and particularly to the formation of a pin seam in a papermakers felts.

Papermakers felt have conventionally been supplied to paper manufacturers as an endless belt. Such an endless belt is formed either by endless weaving of the base fabric prior to needling the felt batt into it, or by flat weaving a length of base fabric and then joining two ends of that fabric to form an endless belt prior to needling the batt. Recently, separable pin seams have become popular on such felts to simplify installation on the papermaking machinery. Such pin seamed felt include a plurality of interlocking loops formed at the opposite extremities of the fabric, with a pintle being inserted through the interengaged loops to form the fabric into an endless belt. Because such pin seams greatly simplify installation, they are rapidly becoming the standard seaming technique for papermakers felts.

While pin seamed felts have significantly simplified the installation of the felts on the presses and other machinery at the papermaking plant, they have brought certain inherent problems. Where the base fabric is of a single layer weave or of a very thin multiple layer weave, the pin seam frequently is thicker than the base fabric itself. When this occurs, passage of such a thickened seam over one of the press rollers or over the edge of an extended nip press tends to impart a bump or bounce to the press fabric and thus to the paper web being carried thereupon. This can result in unacceptably high levels of vibration in the operating presses.

To reduce the bounce caused by passage of the thickened pin seam over the press rolls or through the press nip, it is known to angle the seam as it passes over the rollers. Such angling conventionally has been accomplished by "cocking" the felt on the paper machine at the time it is installed. Also, where the felt is flat woven, it is known to weave or cut the fabric on a bias and then join the ends of the fabric on that bias to accomplish the angled seam. This is done either by weaving a rectangular piece of fabric and cutting the ends or sides at an angle, or by actually weaving the fabric as a parallelogram. All of these prior art practices are difficult to effect and have a high risk of nonuniformity in the finished fabric. Also, all of these procedures except cutting the ends of the fabric on a bias before sewing a seam result in a fabric in which the angled seam is not stable; that is, the seam attempts to straighten itself to extend perpendicular to the direction of travel of the felt. This occurs because the machine direction forces of tension encountered during operation on the paper machine will have a tendency to straighten the machine direction components in the fabric. This also causes the fabric to increase in length and to decrease in width.

SUMMARY OF THE INVENTION

In view of the difficulties noted above, it is an object of the present invention to provide a method of forming a pin seam in a papermakers felt that is angled relative to the direction of movement of the felt. It is a further object of the invention to produce such a structure that features ease of manufacturing and uniformity and also stability in the finished product. To achieve these and other objects of the invention that will become clear to those skilled in the art, there is provided a method of producing an angled pin seam in a papermakers felt. This method includes the steps of weaving a base fabric of a first plurality of yarns extending in the machine direction and a second plurality of yarns extending in the cross machine direction, generally transverse to the machine direction. The base fabric has opposed lateral edges generally parallel to the machine direction and has a selectively joinable seam comprising a plurality of interengageable loops with pintle means inserted through the interengaged loops to form a continuous loop or band of the base fabric. Subsequently, the base fabric and seam are skewed by displacing one of the lateral edges longitudinally of the machine direction relative to the other such lateral edge while maintaining the machine direction yarns extending substantially in the machine direction, whereby the seam will be skewed relative to the machine direction and to the cross machine direction. Subsequently, batt material is needled into the base fabric while the base fabric is maintained in the skewed condition, whereby the needled batt maintains the fabric in the skewed condition.

DETAILED DESCRIPTION OF A PREFERRED EMBODIMENT

Figure 1:
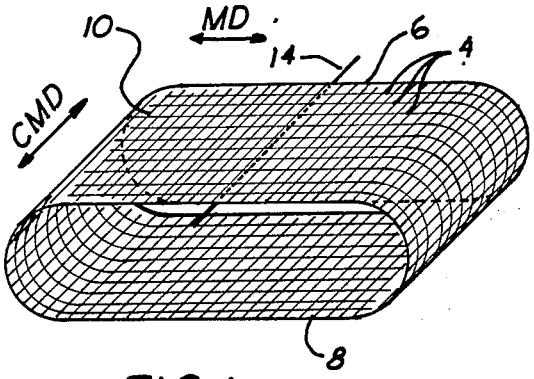
FIG. 1 illustrates an endless band of base fabric having a pin seam for use in the method of the present invention.
Figure 3:
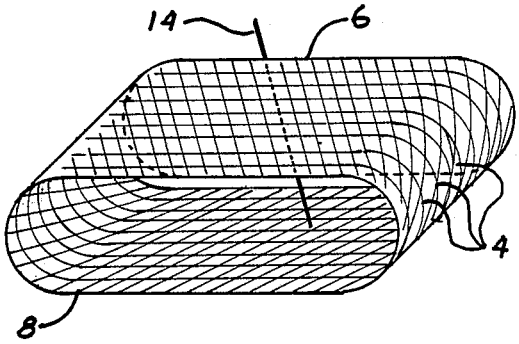
FIG. 3 represents the band of base fabric of FIG. 1 that has been skewed by displacing one lateral edge longitudinally relative to the other lateral edge.
Figure 4:
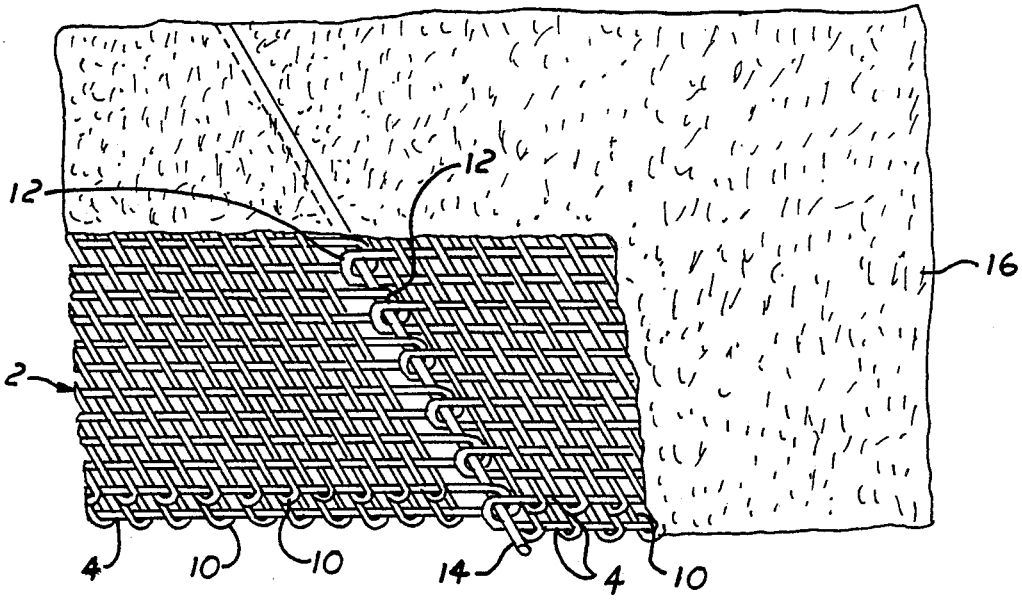
FIG. 4 illustrates a fragmentary portion of the skewed base fabric of FIG. 3 after batt has been applied, with a portion of that batt removed to illustrate the pin seam.

One preferred embodiment of the procedural steps of the present invention is illustrated in the sequential configurations of a base fabric in FIGS. 1-4. FIG. 1 illustrates, schematically, an endless band of a base fabric such as is conventionally used in fabricating a papermakers felt. This base fabric 2 is woven of a first plurality of yarns extending in the machine direction (MD) extending parallel to the opposed lateral edges 8 and 6 of that fabric. A second plurality of yarns 10 extends in the cross machine direction (CMD), generally transverse to the machine direction yarns 4.

Figure 2:
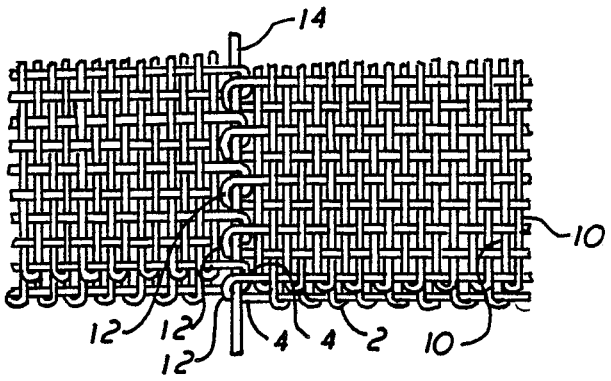
FIG. 2 represents a fragmentary view, on an enlarged scale, of a portion of the fabric and pin seam of FIG. 1.

As shown most clearly in FIG. 2, the base fabric is provided with a selectively joinable seam comprising a plurality of interengageable loops 12, through which is inserted pintle means, such as the pin 14, to form a continuous loop or band of the base fabric, as shown in FIG. 1. Conveniently, the base fabric may either be woven in a typical endless construction including those loops and pintle, or may be woven flat with the loops 12 being formed at the opposed ends of the fabric for subsequent joining. For the purpose of the present invention any suitable weave may be utilized for the base fabric, whether it be single layer or multiple layer, utilizing conventional synthetic yarn in the well known manner.

In the preferred embodiment of this method the fabric loop or band is then loaded onto conventional heat stabilization equipment, which conventionally pulls the entire fabric band taught, generally similar to the manner in which it will be pulled taught on the papermaking equipment. In this embodiment the loop of base fabric is then skewed by displacing the lateral edge 6 longitudinally of the machine direction relative to the lateral edge 8, while maintaining the machine direction yarns 4 extending substantially in the machine direction. By skewing the fabric, the seam and its pintle 14 will thus be skewed relative to the machine direction and to the cross machine direction. Because the machine direction yarns remain extending substantially in the machine direction, the effective overall length of the base fabric loop remains substantially the same as before it was skewed. This skewing operation may effect a slight narrowing of the effective transverse width of the fabric by an amount proportional to the sine of the angle between the cross machine direction yarns and the machine direction. A typical magnitude of skewing may be on the order of 1 inch of skew for every 10 inches of fabric width.

Preferably, with the fabric held in this skewed configuration, it is then heat stabilized. Such heat stabilization softens the yarns in the fabric and allows them to deform around one another in the skewed configuration. Alternatively, the fabric may be skewed after heat stabilization, but such a procedure is more difficult than performing the skewing step prior to heat stabilization.

With the fabric maintained in the skewed configuration, the fabric is loaded onto a batt needling machine, and a conventional papermakers felt batt is needled into the base fabric in the conventional manner, while that base fabric is maintained in the skewed condition. Once the batt fibers have been needled into the base fabric, the felt becomes extremely stable and will easily retain its skewed shape. The remainder of the manufacturing process steps are substantially the same as are used in any seamed fabric having a non-skewed seam.

By forming a papermakers wet felt with an angled seam through the procedure noted above, there are provided a number of benefits. Press vibration is materially reduced, because the seam passes progressively through the nip of the paper machine, and this also results in reduced seam wear. With the seam angled, flexibility about an axis perpendicular to the direction of the felt travel is reduced. This is beneficial because the passage of a non-angled seam of a conventional felt over a straight slotted vacuum box on a paper machine allows the seam to be sucked down into the vacuum box to a certain extent. Then, when the conventional seam exits the box at a high rate of speed, the seam is exposed to high forces that cause excessive noise, wear and vibration, in addition to those problems experienced as the seam passes through the press nip. With the angled seam, the reduced flexibility of the seam perpendicular to the direction of the travel of the felt reduces the tendency for the seamed portion to be drawn down into such a vacuum box slot.

While the foregoing represents a particularly preferred embodiment of the process of this invention, it is to be recognized that numerous variations and modifications of this process, all within the scope of the invention, will readily occur to those skilled in the art. Accordingly, the foregoing is to be considered descriptive merely of the principles of the invention and is not to be considered limitative thereof. The invention is to be limited solely by the claims appended hereto.

What is claimed is:

1. A method of producing an angled pin seam in a papermakers felt, comprising the sequential steps of weaving a base fabric of a first plurality of yarns extending in the machine direction and a second plurality of yarns extending in the cross machine direction generally transverse to said machine direction, with said base fabric having opposed lateral edges generally parallel to said machine direction, said base fabric having a selectively joinable seam comprising a plurality of interengageable loops through which extends pintle means to form a continuous loop of said base fabric;

skewing said base fabric and seam by displacing one said lateral edge longitudinally of said machine direction relative to the other said lateral edge while maintaining said machine direction yarns extending substantially in the machine direction, whereby said seam will be skewed relative to said machine direction and to said cross machine direction; and needling batt material into said base fabric while said base fabric is maintained in said skewed condition, whereby the needled batt maintains the fabric in the skewed condition.

2. The method of claim 1 further comprising the step of heat setting said base fabric prior to said needling step.

3. The method of claim 2 wherein said heat setting step is performed prior to said skewing step.

4. The method of claim 2 wherein said heat setting step is performed after said skewing step.

5. The method of any of claims 1 through 4 wherein said base fabric is woven as an endless weave.

6. The method of any of claims 1 through 4 wherein said base fabric is flat woven.

* * * * *